US007327317B2

(12) United States Patent
Heiniger

(10) Patent No.: US 7,327,317 B2
(45) Date of Patent: Feb. 5, 2008

(54) DUAL-POLARIZED MICROSTRIP PATCH ANTENNA

(75) Inventor: Markus Heiniger, Herisau (CH)

(73) Assignee: Huber + Suhner AG, Herisau (CH)

( * ) Notice: Subject to any disclaimer, the term of this patent is extended or adjusted under 35 U.S.C. 154(b) by 233 days.

(21) Appl. No.: 11/331,834

(22) Filed: Jan. 13, 2006

(65) Prior Publication Data

US 2006/0139215 A1 Jun. 29, 2006

Related U.S. Application Data

(63) Continuation of application No. PCT/CH03/00481, filed on Jul. 16, 2003.

(51) Int. Cl.
*H01Q 1/38* (2006.01)

(52) U.S. Cl. ..... 343/700 MS

(58) Field of Classification Search ..... 343/700 MS, 343/829, 846

See application file for complete search history.

(56) References Cited

U.S. PATENT DOCUMENTS

| | | | | |
|---|---|---|---|---|
| 4,191,959 | A * | 3/1980 | Kerr | 343/700 MS |
| 5,355,143 | A | 10/1994 | Zürcher et al. | |
| 5,453,754 | A * | 9/1995 | Fray | 343/789 |
| 5,745,080 | A | 4/1998 | Jun | |
| 6,031,491 | A * | 2/2000 | Daniel et al. | 343/700 MS |
| 6,104,347 | A | 8/2000 | Snygg et al. | |
| 6,577,276 | B2 | 6/2003 | Lovestead | |
| 6,664,932 | B2 * | 12/2003 | Sabet et al. | 343/770 |
| 2002/0089452 | A1 | 7/2002 | Lovestead | |
| 2003/0063031 | A1 | 4/2003 | Wong et al. | |

FOREIGN PATENT DOCUMENTS

| | | | |
|---|---|---|---|
| EP | 1 006 608 | A1 | 6/2000 |
| JP | 56-160103 | A1 | 12/1981 |
| WO | WO 98/54785 | A1 | 12/1998 |
| WO | WO 99/17403 | A1 | 4/1999 |

OTHER PUBLICATIONS

Shu-Shi Zhong et al, "Corner-Fed Microstrip Antenna Element and Arrays for Dual-Polarization Operation," IEEE Transactions on Antennas and Propagation, vol. 50, Issue 10, pp. 1473-1480, no date.

* cited by examiner

*Primary Examiner*—Tho Phan
(74) *Attorney, Agent, or Firm*—Burr & Brown

(57) ABSTRACT

The invention relates to a dual polarised microstrip patch antenna comprising at least one individual element, each individual element comprising at least one rectangular, preferably quadratic, patch arranged on the upper face of a printed circuit board, having a feed network on the upper side thereof and being metallized on the entire surface of the lower face thereof. The aim of the invention is to improve the polarization isolation, while simultaneously simplifying the feed network. To this end, the feed network is embodied in such a way that the feed is only fed on two corners of the patch, and the at least one patch is modified in such a way that the isolation is improved between the polarizations of at least one antenna element and a plurality of individual antenna elements in relation to a non-modified patch.

21 Claims, 6 Drawing Sheets

Fig.1
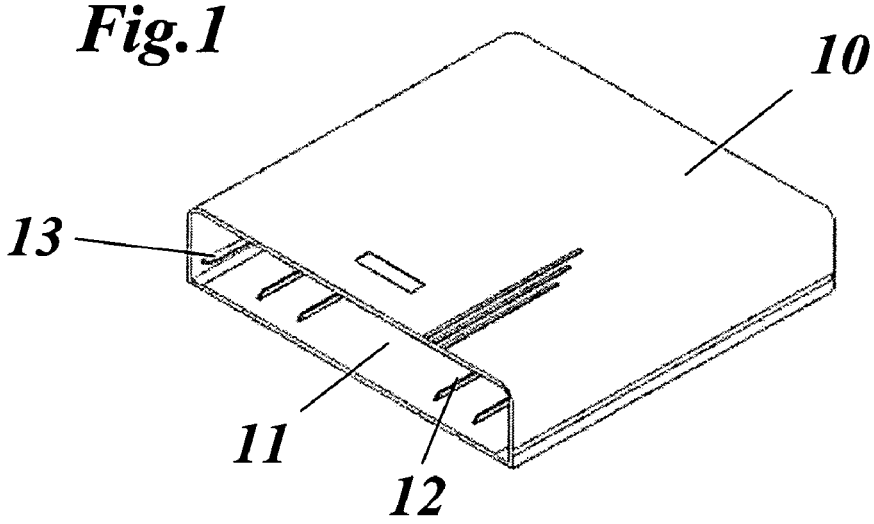
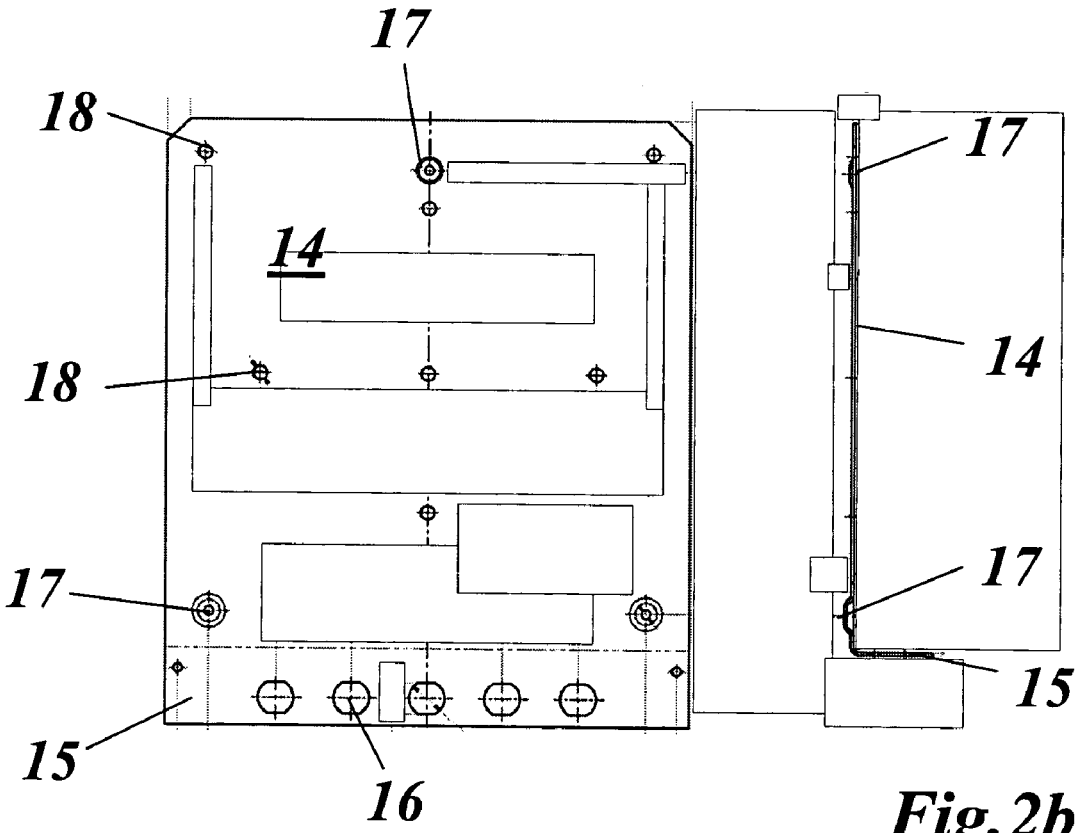
Fig.2b
Fig.2a

DUAL-POLARIZED MICROSTRIP PATCH ANTENNA

CROSS REFERENCE TO RELATED APPLICATIONS

This application is a continuation of International Application No. PCT/CH2003/000481 having an international filing date of Jul. 16, 2003, which designated the United States, the entirety of which is incorporated herein by reference.

FIELD OF THE INVENTION

The present invention relates to the field of antenna technology. It relates in particular to a dual-polarized microstrip patch antenna.

BACKGROUND OF THE INVENTION

Network operators use the principle of polarization diversity in order to improve the transmission characteristics of a radio system. The conversion of linearly vertically polarized antennas to dual linearly polarized antennas took place several years ago in the GSM range (900 MHz and 1800 MHz). Only dual linearly polarized antennas have ever been used, from the start, in the UMTS range (2100 MHz). The requirement for dual linearly polarized antennas is now also being increasingly adopted in the WLAN range (2.4 GHz and 5.6 GHz).

Many of the dual linearly polarized antennas which have been proposed in the past are based on so-called SSFIP technology (SSFIP=Strip Slot Foam Inverted Patch), that is to say they relate to a slot-coupled patch antenna (see, for example, U.S. Pat. No. 5,355,143 (Zürcher et al.) or WO-A1-99/17403 (Sanzgiri et al.) or WO-Al-98/54785). One major disadvantage of these antennas is that the slot emits on both sides: on the one hand in the desired direction towards the patch and on the other hand in the opposite direction towards the reflector. This causes undesirable wave propagation, which leads to coupling between the polarizations of individual elements. Furthermore, undesirable coupling occurs between the individual antenna elements in an array of individual elements. In the past, it has been possible to suppress this coupling by suitable measures to such an extent that it was possible to achieve 30 dB isolation, which is the minimum requirement. As can easily be imagined, this disadvantage becomes more noticeable and limiting at higher frequencies.

The above disadvantage can be avoided by using a microstrip patch antenna. The isolation of a dual linearly polarized microstrip patch antenna is about 15 dB. The article by S. Assailly et al. "Some Results on Broad-Band Microstrip Antenna with Low Cross Polar and High Gain", IEEE Trans. Antennas Propagat. Vol. 39, no. 3, p. 413-415 (March 1991), describes one option for improvement of the isolation. All 4 corners of the patch are fed, with the respectively opposite corner being fed with the phase shift of 180°. This results in very good isolation, although this solution has the disadvantage that it requires a relatively complicated feed network.

SUMMARY OF THE INVENTION

One object of the invention is thus to provide a dual polarized microstrip patch antenna, which requires only a simple feed network, that achieves considerably better isolation than SSFIP-based antennas.

This object is achieved by the dual polarized microstrip patch antenna of the present invention by having one or more individual elements with at least one rectangular patch and a feed network on the upper face of a printed circuit board with the lower face of the printed circuit board being completely metallized and a feed network feeding only two corners of the patch. The patch has modifications to improve isolation between the polarizations of at least one antenna element and a plurality of individual antenna elements.

In a first embodiment of the present invention, the modifications are arranged on the edges of the patch. These modifications may include two notches on opposite edges of the patch which, in particular, are rectangular and have a width of up to about 0.1λ and a depth of up to about 0.1λ, where λ is the wavelength at the operating frequency of the antenna. However, the modifications may also be encompassed by two lugs on opposite edges of the patch which, in particular, are rectangular and have a width of up to about 0.1λ and a depth of up to about 0.1 λ, where λ is the wavelength at the operating frequency of the antenna. Additionally, it is also feasible for the modifications to comprise cut-off corners at the corners of the patch, in which case, in particular, the cut-off corners are inclined at an angle of 45° with respect to the edges of the patch and have a length of up to about 0.1λ, where λ is the wavelength at the operating frequency of the antenna.

In a second embodiment of the present invention, the modifications are arranged in the center of the patch, with the modifications including a slot which runs parallel to the edges of the patch, is preferably rectangular and has a length of up to about 0.2λ, and a width of up to about 0.05λ, where λ is the wavelength at the operating frequency of the antenna.

Particularly advantageous isolation is obtained according to another embodiment of the invention in which a plurality of different modifications are combined with one another in the at least one patch.

The patch may be arranged with the edges parallel to the x axis and y axis of the antenna. However, it can also be arranged with the edges rotated through 45° with respect to the x axis and y axis of the antenna.

It is particularly advantageous for a plurality of patches to be arranged at a distance one above the other within the individual elements to increase bandwidth. In this case, it is advantageous for an individual element's plurality of patches to have at least one of a different group of modifications or a different orientation of the edges with respect to the x axis and y axis of the antenna.

In another embodiment of the present invention, a plurality of individual elements are arranged alongside one another in an array. In this case, it is particularly advantageous for the patches in the plurality of individual elements in an array to have at least one of different modifications or a different orientation with respect to the x axis or y axis of the antenna.

A particularly simple overall antenna design is obtained where a plurality of patches are arranged one above the other with the upper patches being mounted on the printed circuit board by means of spacers, and the printed circuit board mounted by means of spacers on a metal sheet, which can be inserted into a shroud which is open on one side.

BRIEF DESCRIPTION OF THE DRAWINGS

The invention will be explained in more detail in the following text using exemplary embodiments in conjunction with the drawings, in which:

FIG. 1 shows a perspective view of the shroud of a dual-polarized microstrip patch antenna according to one embodiment of the invention;

FIG. 2*a* shows a plan view from above of the supporting metal sheet, which can be inserted into the antenna shroud shown in FIG. 1, and FIG. 2*b* shows a side view of the supporting metal sheet;

DETAILED DESCRIPTION OF THE INVENTION

Figure 8:
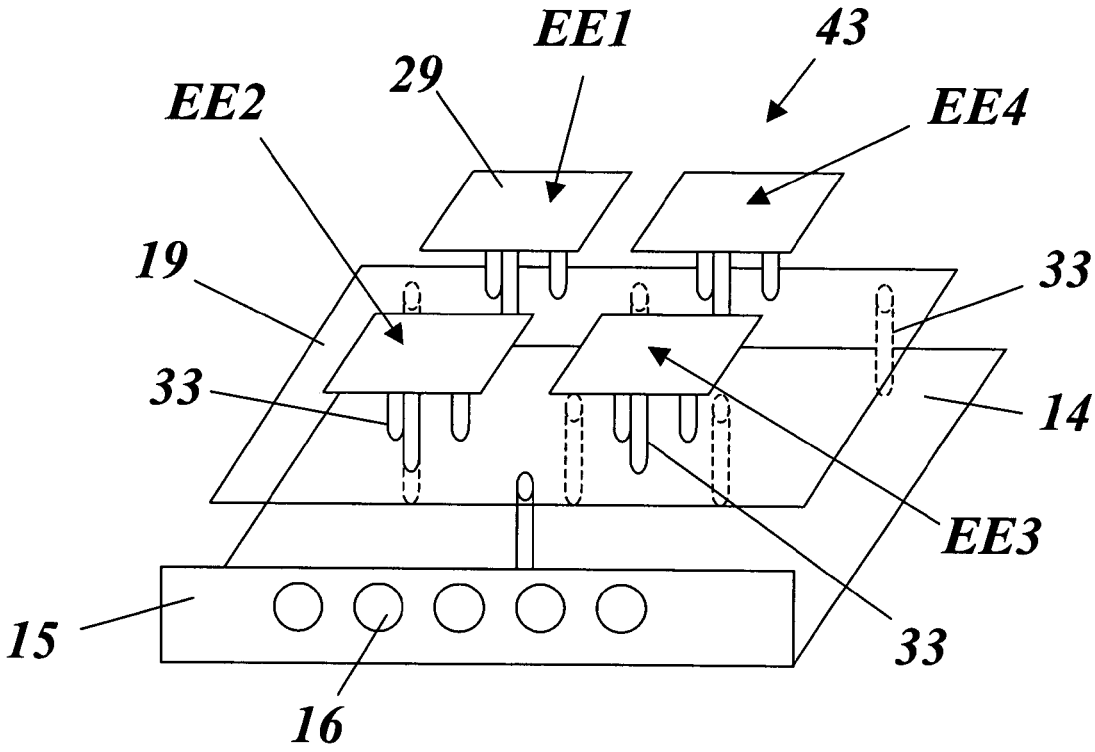
FIG. 8 shows a perspective view of a schematic design of the antenna with the stack comprising the metal sheet, printed circuit board and upper patches.

FIG. 8 shows a perspective illustration of a highly simplified form of a microstrip patch antenna according to one embodiment of the present invention. The antenna 43 essentially comprises a metal sheet 14 and four individual antenna elements EE1-EE4 which are mounted on the metal sheet 14 in a square shaped pattern and at a distance above the upper face of the metal sheet. The shroud 10 of the microstrip patch antenna 43, which is illustrated in FIG. 1, has been omitted in FIG. 8 for clarity. The individual elements EE1-EE4 are composed of a common printed circuit board (PCB) 19, PCB surface mounted patches 20-23 and a feed network 44, and at least one upper patch 29 arranged at a distance above the printed circuit board 19. The upper patch/patches 29 govern increases in the bandwidth.

Figure 3:
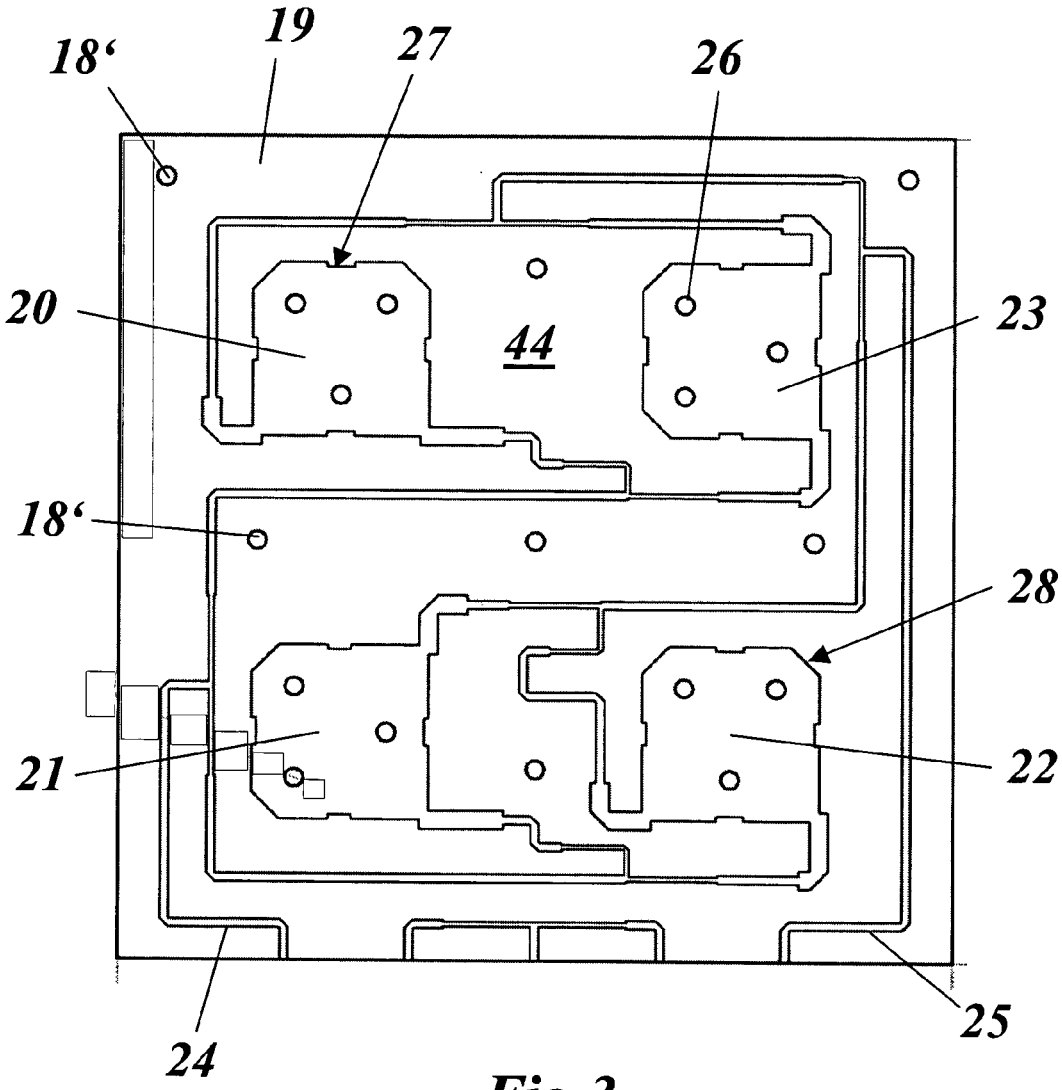
FIG. 3 shows a preferred printed circuit board with the feed network formed on the upper face and four patches, arranged in an array, as the basis of an individual element.

FIG. 3 depicts one embodiment of printed circuit board 19 in which a feed network 44 is formed on the upper face of printed circuit board 19. The lower face of printed circuit board 19 is completely metallized. The feed network 44 has two branching conductor tracks, 24 and 25, which are connected to the two adjacent corners of printed circuit board 19. The upper face of printed circuit board 19 also includes surface patches 20-23, which interface to and are fed by feed network 44. As shown in FIG. 2, the conductor tracks 24 and 25 are connected to externally accessible connectors (not shown) on the lower transverse face of the printed circuit board 19. These externally accessible connectors are mounted by means of holes 16 in an angled area (angle 15) of the metal sheet 14. The connections between branching conductor tracks, 24 and 25 of feed network 44 and each of the surface patches 20-23 may be different. For example, as shown in FIG. 3, the lower left-hand corner of patch 20 is connected to the conductor track 25 and the lower right-hand corner is connected to the conductor track 24. This connection orientation also applies to patch 22. In contrast, the lower right-hand corners of patches 21 and 23 are connected to conductor track 24 and the upper right-hand corners are connected to the conductor track 25. In addition, each of patches 20-23 has a rectangular notch 27 on or near the midpoint of each of its four faces and cut-off corners 28. In the embodiment shown in FIG. 3, the cut-off corners 28 are angled at 45° and provide connection to conductive areas which are not connected to the conductor tracks 24 and 25. The notches 27 and cut-off corners 28 modify the intrinsic characteristics of a square patch, thereby increasing the isolation between the polarizations.

Three patch mounting holes 26 are arranged in a triangular pattern within each of the mounting points for patches 20-23 on the upper face of the printed circuit board 19, as shown in FIG. 3. Mounting hole spacers 33, of the type illustrated in FIG. 5, can be inserted through the mounting holes to latch patches 20-23 to printed circuit board 19 and latch upper patches 29 to printed circuit board 19 at a distance above the printed circuit board's upper face (see also FIG. 8). In addition, seven mounting holes 18' are provided on the upper face of printed circuit board 19. The printed circuit board's seven mounting holes 18' are positioned identically to the mounting holes 18 on the metal sheet 14. The mounting holes 18' and mounting holes 18 are provided as a means to attach the printed circuit board 19 and metal sheet 14. For example, mounting hole spacers 33 can be inserted through mounting holes 18 and 18' and latch the printed circuit board 19 to the metal sheet 14 at a distance above the metal sheet (see FIGS. 5 and 8).

Figure 4:
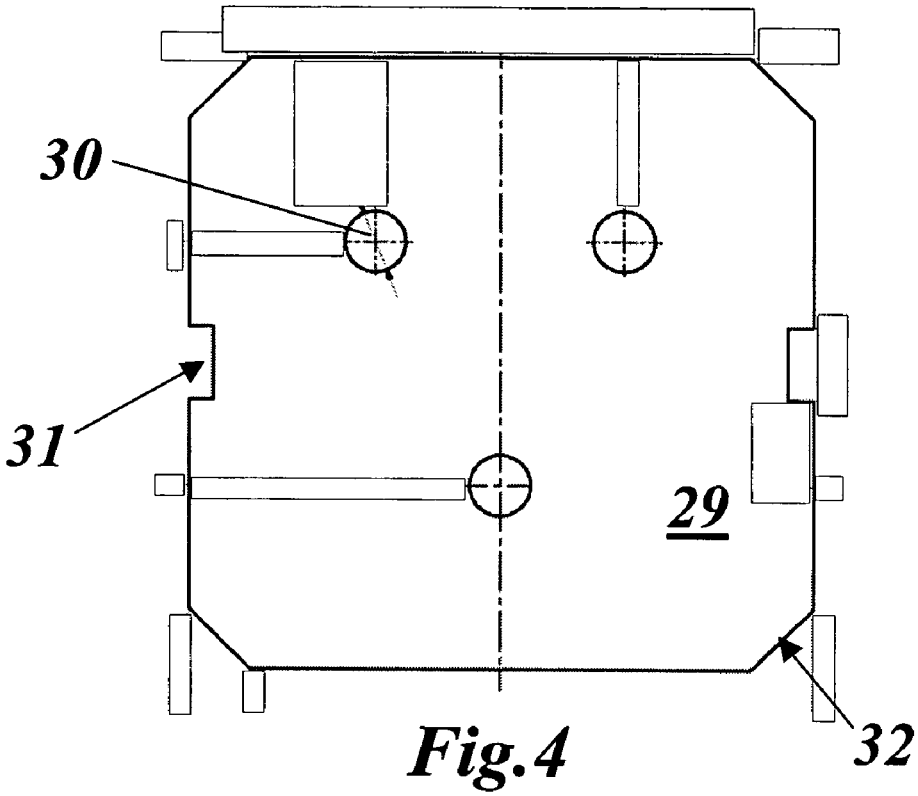
FIG. 4 shows a plan view of the patch, arranged above the printed circuit board, of an individual element of the antenna of one embodiment of the antenna.

FIG. 4 illustrates one example of an upper patch 29, which is fixed at a distance above surface patches 20-23. The patch 29 comprises a metal sheet having a thickness of, for example, 1 mm, which is similar to the thickness of the metal sheet 14. Patch 29 has mounting holes 30, whose number and arrangement are matched to the mounting holes 26 in patches 20-23. The example of a patch 29, depicted in FIG. 4, has two centrally arranged rectangular notches 31 on two opposite faces and cut-off corners 32 at all four corners. Again, the cut-off corners 32 and notches 31 are examples of modifications to the patch that improve the isolation between the polarizations of individual antenna elements. Additional suitable patch modifications are illustrated in FIGS. 6 and 7, and will be discussed further below.

The mechanical design of the antenna of a preferred embodiment is completed by a shroud 10, as shown in FIG. 1. The shroud 10 is produced from a suitable plastic (for example Luran®) and is provided with internal bottom and side rails 12 and 13, respectively, which guide the metal sheet 14 into the shroud 10 during the insertion into the shroud 10. The shroud 10 has an insertion opening 11 on one transverse face. The insertion opening 11 is covered by an angle 15 on the angled metal sheet 14 when the metal sheet 14 has been inserted into the shroud 10. The electrical part of the printed circuit board 19, which is seated on the metal sheet 14, is externally accessible through the connecting sockets which are inserted into the holes 16. Support for the metal sheet 14 and shroud 10 is provided by a plurality of feet 17 that are stamped into the metal sheet 14.

Figures 5A, 5B:
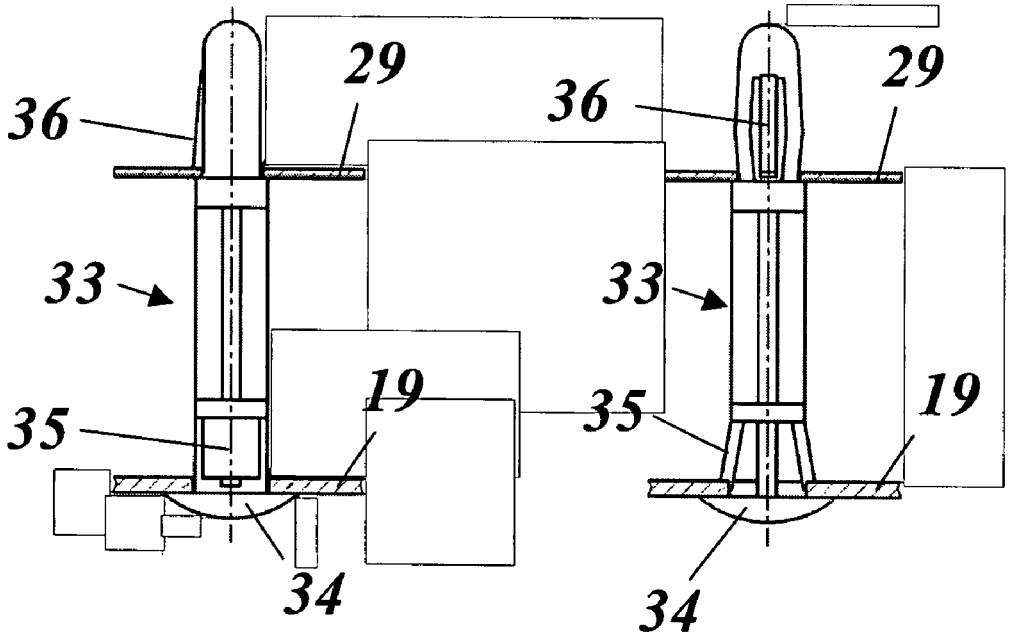
FIG. 5 shows two orthogonal side views of a spacer for mounting the upper patches on the printed circuit board in one embodiment of the antenna.

As has already been explained further above, the upper patches 29 are mounted by means of mounting hole spacers 33 at a distance above the printed circuit board 19, and the printed circuit board 19 is mounted by means of spacers 33 at a distance above the metal sheet 14. The spacers 33, which are illustrated in the two side views of FIG. 5, are formed from plastic (for example polyamide) and, in a preferred embodiment, are designed for a distance of 5 mm between the patch 29 and the printed circuit board 19 and the metal sheet 14. As shown in FIG. 5, spacers 33 have a spacer head in the form of a cup at the lower end and a rounded upper end and a center section with latching tongues 35 and 36 projecting from the sides of the center section. More specifically, latching tongues 35 are arranged a short distance behind the head 34 and latching tongues 36 are positioned behind a step which is located further upwards, closer to the upper end of spacer 33. Functionally, the spacer 33 is pushed until the head of the spacer 33 is in contact with the surface of the printed circuit board 19 or upper patches 29, and the latching tongues 35 and 36 clear the mounting hole and spring outwards, thereby latching the printed circuit board 19 and the metal sheet 14 or the printed circuit board 19 and the upper patches 29.

Figure 6A:
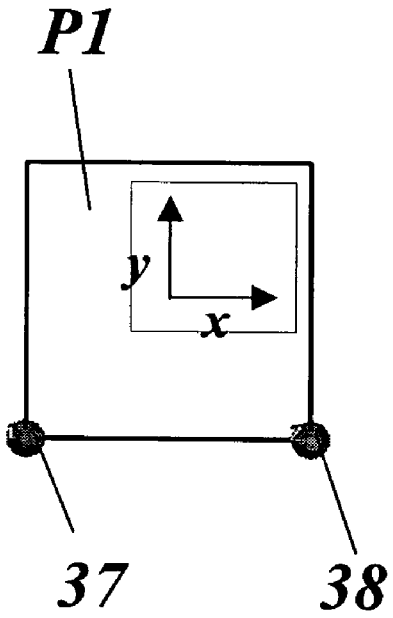
FIGS. 6*a* and 6*b* show the feed points for two differently oriented patches.
Figure 6B:
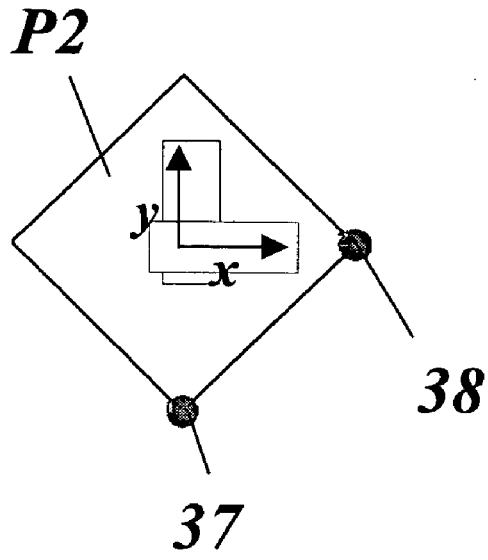
Figure 6C:
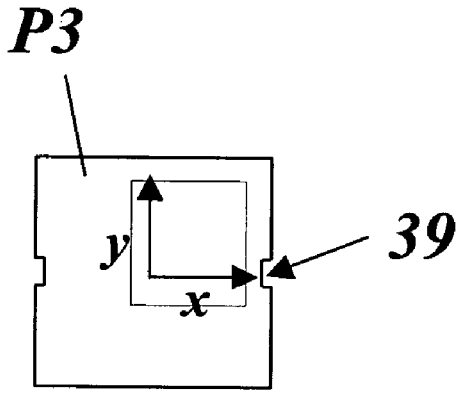
FIGS. 6*c* and 6*d* show two patches with modifications in the form of notches on the edges.
Figure 6D:
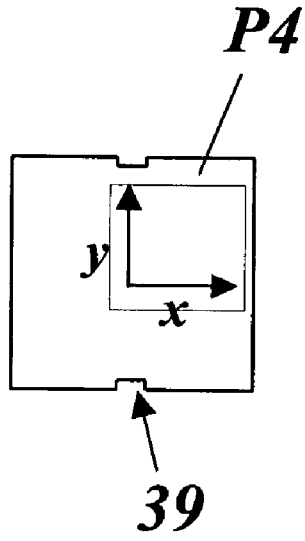

FIGS. 6*a* and 6*b* show two ways patches 20-23 can be fed at the two adjacent corners. In FIG. 6*a*, the edges of the patch P1 are parallel to the x axis and y axis (see the coordinates that are shown). The feed is provided at the feed points 37, 38. Dual linear polarization is used, with a slant of ±45°. In FIG. 6*b*, the edges of the patch P2 are rotated through 45° with respect to the x axis and y axis. The feed is once again provided at the corners (feed points 37, 38). Dual linear polarization is used, to be precise vertical and horizontal polarization.

Figure 7A:
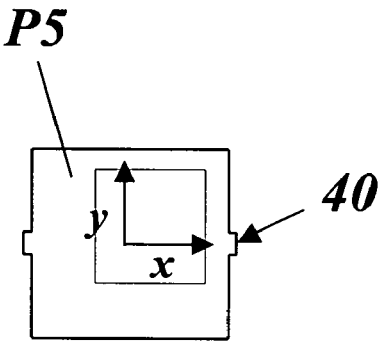
FIGS. 7*a* and 7*b* show two patches with modifications in the form of lugs on the edges.
Figure 7B:
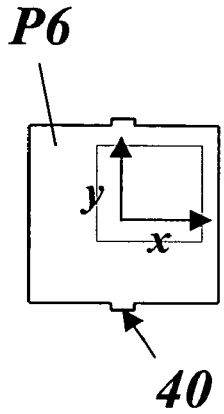
Figure 7C:
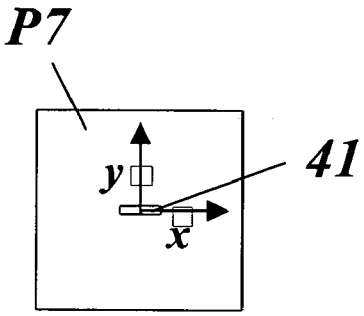
FIGS. 7*c* and 7*d* show two patches with a central slot.
Figure 7D:
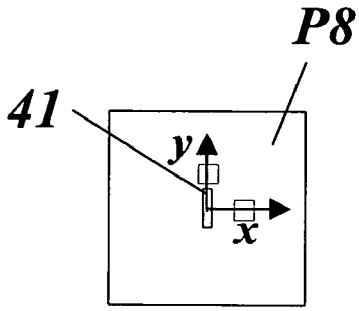
Figure 7E:
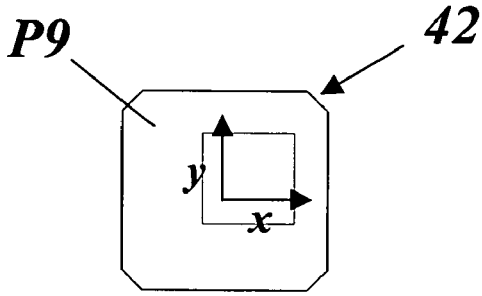
FIG. 7*e* shows a patch which has been cut off at the corners.

As has already been mentioned in conjunction with FIG. 4 for patch 29, the patches can be changed by different modifications. In the case of the patches P3 and P4, shown in FIGS. 6*c* and 6*d*, two rectangular notches 39 are provided in the center of two opposite edges as modifications. The dimensions of the notches 39 depend on the wavelength at the operating frequency of the antenna, λ, and are preferably up to about 0.1λ in width and up to about 0.1λ in length. The patches P3 and P4 may also be rotated through 45° with respect to the x axis and y axis. In the case of the patches P5 and P6 shown in FIGS. 7*a* and 7*b*, two rectangular lugs 40 are provided in the center of two opposite edges, as modifications. The dimensions of the lugs 40 are preferably up to about 0.1λ in width and up to about 0.1λ in length. The patches P5 and P6 may also be rotated through 45° with respect to the x axis and y axis. In FIGS. 7*c* and 7*d*, a rectangular slot 41 is provided in the center of patches P7 and P8, respectively, as a modification. The dimensions of the slot 41 are preferably up to about 0.05λ in width and up to about 0.2λ in length. In this case as well, the patches P7 and P8 may be rotated through 45° with respect to the x axis and y axis. In the case of the patch P9 shown in FIG. 7*e*, the modification comprises the corners being cut off. The cut-off corners 42 are inclined at 45°, and preferably have a length of up to about 0.1λ. In this case as well, the patch can be rotated through 45°, once again.

The described modifications to the patches 20-23 and 29 and P3-P9 allow the isolation between the polarizations to be improved considerably. Very good isolation values are obtained by a suitable combination of these measures (for example notches and cut-off corners or the like). The described microstrip patch antenna 43 has a very narrow bandwidth. This bandwidth can be increased by the use of additional patches, which are placed on the already existing patches, at a distance from them.

The isolation can be improved further by a suitable combination of the patch modifications. In this case the modifications to a plurality of patches which are arranged one above the other (in a "stack") may differ. For example, the lower patch has notches and the upper patch has lugs. The polarization is governed by the connections and feed of the lower patch. The upper patch can be rotated through 45° with respect to the lower.

The isolation in an array comprising a plurality of individual elements arranged alongside one another can be improved by the patches in the individual elements having different modifications. The antenna, which is shown as an exemplary embodiment in the figures, has external dimensions (of the shroud 10) of about 200 mm×200 mm×43 mm. The upper patches 29 have dimensions of 50 mm×50 mm×1 mm. This represents a 2×2 array with 4 individual elements, with each individual element having two patches 20-23 and 29, which are arranged one above the other by means of spacers.

LIST OF REFERENCE SYMBOLS

10 Shroud
11 Insertion opening
12 Bottom rail
13 Side rail
14 Metal sheet
15 Angle
16 Hole
17 Foot
18, 18' Mounting hole
19 Printed circuit board
20, . . . , 23 Patch (PCB)
24, 25 Conductor track
26 Mounting hole
27 Notch
28 Cut-off corner
29 Patch (metal sheet)
30 Mounting hole
31 Notch
32 Cut-off corner
33 Spacer
34 Head (in the form of a cup)
35, 36 Latching tongue
37, 38 Feed point
39 Notch
40 Lug
41 Slot
42 Cut-off corner
43 Microstrip patch antenna
44 Feed network
EE1, . . . , EE4 Individual element
P1, . . . , P9 Patch metal sheet

The invention claimed is:

1. A dual-polarized microstrip patch antenna having one or more individual elements with each of said one or more individual elements having at least one rectangular patch arranged on the upper face of a printed circuit board having a feed network on said upper face and having metallization over the entire surface of the lower face, wherein said feed network permits feed to take place only at two corners of the patch, and wherein said at least one patch has modifications that improve the isolation between the polarizations of said one or more individual elements, in comparison to an unmodified patch.

2. The antenna of claim 1, wherein said modifications are arranged at the edges of said patch.

3. The antenna of claim 2, wherein said modifications comprise two notches on opposite edges of said patch.

4. The antenna of claim 3, wherein said notches are rectangular and have a width of up to about 0.1λ and a depth of up to about 0.1λ, where λ is the wavelength of the operating frequency of the antenna.

5. The antenna of claim 2, wherein said modifications comprise two lugs on opposite edges of said patch.

6. The antenna of claim 5, wherein said lugs are rectangular and have a width of up to about 0.1λ and a depth of up to about 0.1λ, where λ is the wavelength at the operating frequency of the antenna.

7. The antenna of claim 2, wherein said modifications comprise cut-off corners at the corners of said patch.

8. The antenna of claim 7, wherein said cut-off corners are inclined at an angle of 45° with respect to the edges of said patch and have a length of up to about 0.1λ, where λ is the wavelength at the operating frequency of the antenna.

9. The antenna of claim 1, wherein said modifications are arranged in the center of said patch.

10. The antenna of claim 9, wherein said modifications comprise a slot which runs parallel to the edges of said patch.

11. The antenna of claim 10, wherein said slot is rectangular and has a length of up to about 0.2λ, and a width of up to about 0.05λ, where λ is the wavelength at the operating frequency of the antenna.

12. The antenna of claim 1, wherein a plurality of different modifications are combined with one another for said at least one patch.

13. The antenna of claim 1, wherein said patch is arranged with the edges parallel to the x axis and y axis of the antenna.

14. The antenna of claim 1, wherein said patch is arranged with the edges rotated through 45° with respect to the x axis and y axis of the antenna.

15. The antenna of claim 1, wherein a plurality of patches are arranged at a distance one above the other within the individual elements to increase the bandwidth.

16. The antenna of in claim 15, wherein said plurality of patches of an individual element have at least one of different modifications and a different orientation of the edges with respect to the x axis and y axis of the antenna.

17. The antenna of claim 15, wherein said upper patches are mounted on the printed circuit board by means of spacers.

18. The antenna of claim 1, wherein a plurality of individual elements are arranged alongside one another in an array.

19. The antenna of claim 18, wherein said patches of said individual elements in an array have at least one of different modifications and are a different orientation of the edges with respect to the x axis or y axis of the antenna.

20. The antenna of claim 1, wherein said printed circuit board is mounted on a metal sheet, with the patches, by means of spacers, and the metal sheet can be inserted into a shroud which is open on one side.

21. The antenna of claim 1, wherein said patch is square.

* * * * *